United States Patent [19]

Breuer et al.

[11] Patent Number: 4,548,444

[45] Date of Patent: Oct. 22, 1985

[54] MINERAL WINNING PLOUGH

[75] Inventors: Oswald Breuer, Dortmund; Norbert Hesse; Bernd Steinkuhl, both of Lünen, all of Fed. Rep. of Germany

[73] Assignee: Gewerkschaft Eisenhutte Westfalia, Lunen, Fed. Rep. of Germany

[21] Appl. No.: 504,508

[22] Filed: Jun. 15, 1983

[30] Foreign Application Priority Data

Jun. 19, 1982 [DE] Fed. Rep. of Germany ..... 3222984

[51] Int. Cl.[4] ..... E21C 27/32

[52] U.S. Cl. ..... 299/34; 299/76

[58] Field of Search ..... 299/34, 76, 80, 71; 175/382; 74/424.6

[56] References Cited

U.S. PATENT DOCUMENTS 2,010,774 12/1911 Lange ..... 74/424.6

4,275,927 6/1981 Merten et al. ..... 299/80

OTHER PUBLICATIONS

*Five Hundred and Seven Mechanical Movements,* Henry T. Brown, 1868, pp. 68–69.

*Primary Examiner*—Stephen J. Novosad
*Assistant Examiner*—Michael Goodwin
*Attorney, Agent, or Firm*—M. E. Gauthier

[57] ABSTRACT

A plough for winning material (such as coal) from a face has a plough body which supports a carrier for roof-level cutters. Means are provided for adjusting the vertical position of the carrier with respect to the plough body. The adjustment means comprises a worm mounted on the plough body, and a toothed rack associated with the carrier. The worm meshes with the toothed rack. The worm is driven through a reduction gear which is located on the goaf side of the carrier.

10 Claims, 3 Drawing Figures

FIG.1
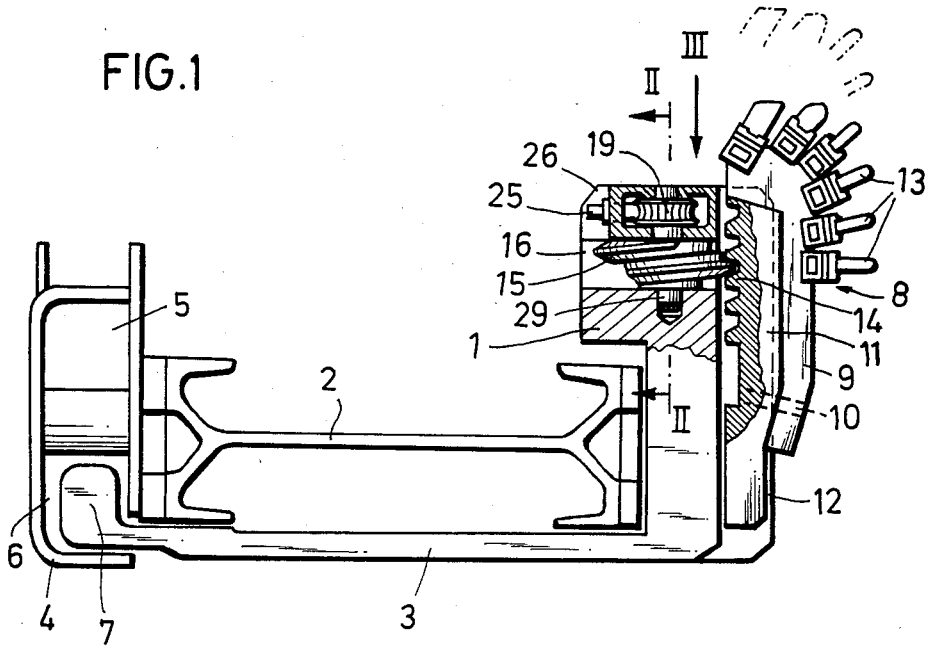
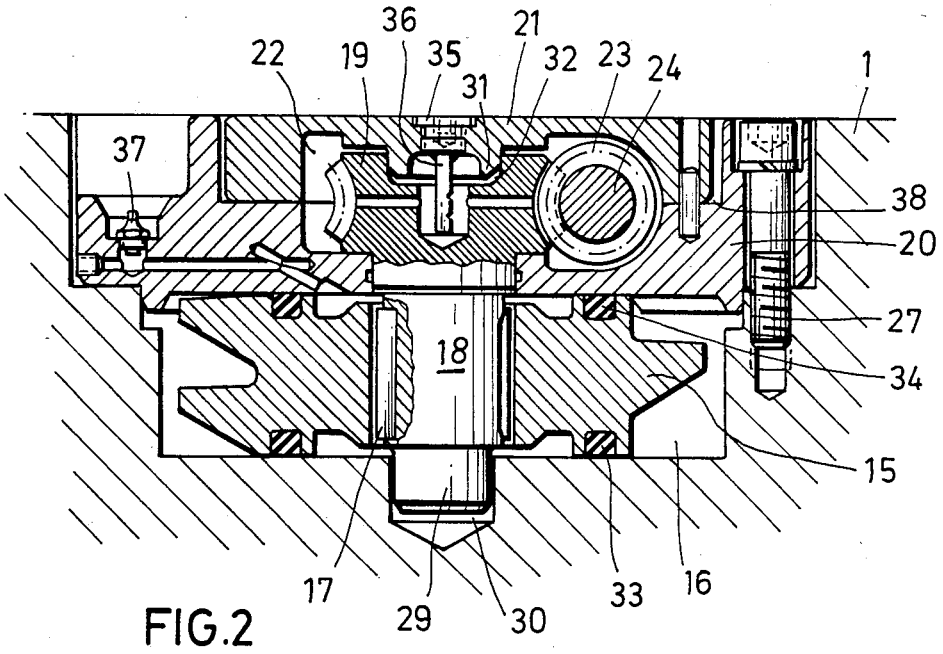
FIG.2

MINERAL WINNING PLOUGH

BACKGROUND TO THE INVENTION

This invention relates to a plough for winning a mineral material, such as coal, from a mineral face or seam in a mine working.

In order to win coal in the roof zone of a mine working, particularly in seams of varying thickness, it is known to provide coal ploughs with roof cutters mounted on a vertically adjustable carrier. The level of the carrier may be adjusted by means of a worm gear having a worm meshing with a toothed rack. The worm is rotatably supported by the body of the plough, and the toothed rack is provided on the carrier. See (U.S. Pat. No. 4,275,927).

The worm gear of this known arrangement enables the level of the carrier to be varied infinitely. The worm is actuated by a hand lever which is mounted on the shaft which rotatably supports the worm in a chamber at the top side of the plough body. The worm is located at the side of the carrier. The carrier consists of a carrier plate which is coupled to a slide-like guide plate. The guide plate is provided with serrations, and so constitutes the toothed rack of the worm gear. Cutters are mounted on the carrier plate.

The aim of the invention is to provide a mineral winning plough having an improved form of roof cutter carrier adjusting means, and in particular an adjusting means which can be operated from the goaf side of the plough in a trouble-free manner, and by the application of a relatively low manual force.

SUMMARY OF THE INVENTION

The present invention provides a plough for winning material from a mineral face, the plough having a plough body, a carrier for roof-level cutters, and means for adjusting the vertical position of the carrier with respect to the plough body, the adjustment means being constituted by a worm mounted on the plough body and a toothed rack associated with the carrier, the worm meshing with the toothed rack, wherein the worm is drivable through a reduction gear which is located on the goaf side of the carrier.

Preferably, the reduction gear has a reduction ratio of 20:1, so that the level of the carrier can be adjusted by means of low manual force. The reduction gear is located in a space-saving position at the goaf side of the carrier, so that it can be actuated from the goaf side. Advantageously, the reduction gear has an input shaft which extends substantially at right-angles to the axis of the worm, the free end of the input shaft being directed towards the goaf side of the carrier.

In a preferred embodiment, the worm is rotatably mounted in a worm chamber formed in the plough body by means of a substantially vertical shaft fixed to the worm, the worm chamber being open on that side which faces the toothed rack. The toothed rack may be constituted by serrations formed on the rear (goaf-side) face of the carrier, where they are substantially unaffected by contamination.

Advantageously, one end of the worm shaft is journalled in an aperture formed in the plough body, the other end of the worm shaft being journalled on a cover which is detachably mounted on the plough body. Preferably, the cover has a centering and bearing stud which engages in a recess formed in the end face of the worm shaft, thereby journalling the worm shaft on the cover.

The worm chamber may be covered by a detachable housing plate, and the worm may be provided with sealing rings which seal against the inner face of the housing plate and the base of the worm chamber defined by the plough body. The sealing rings provide a circular seal at both sides of the worm, so that the worm chamber accommodating the adjusting gear is protected against the entry of dirt, and may be filled with a lubricating oil. Preferably, the cover overlies the housing plate; and the housing plate and the cover are positioned in a recess in the plough body, said recess defining the worm chamber.

In a preferred embodiment, the reduction gear is constituted by a second worm mounted on the input shaft. the second worm meshing with a worm wheel mounted on the worm shaft. The second worm and the worm wheel constitute a worm gear of simple and robust construction, and of small dimensions. The worm shaft, which carries the worm, also carries the worm wheel. This shaft is mounted at both ends without using separate roller bearings, and this results in a particularly simple overall construction, and in easy assembly and removal of the adjusting gear.

Preferably, the housing plate and the cover together form a gear chamber which houses the worm wheel and the second worm. Advantageously, the plane of separation between the housing plate and the cover coincides with the mediam plane of the second worm. With the cover detached, the worms and worm wheel can be fitted and removed in a simple manner.

BRIEF DESCRIPTION OF THE DRAWINGS

One form of coal plough constructed in accordance with the invention will now be described, by way of example, with reference to the accompanying drawings, in which:

FIG. 1 is a part-sectional, diagrammatic, end elevation of the plough;

FIG. 2 is an enlarged cross-section taken on the line II—II of FIG. 1; and, FIG. 3 is a plan view of part of the plough looking in the direction indicated by the arrow III in FIG. 1.

DESCRIPTION OF PREFERRED EMBODIMENT

Figure 3:
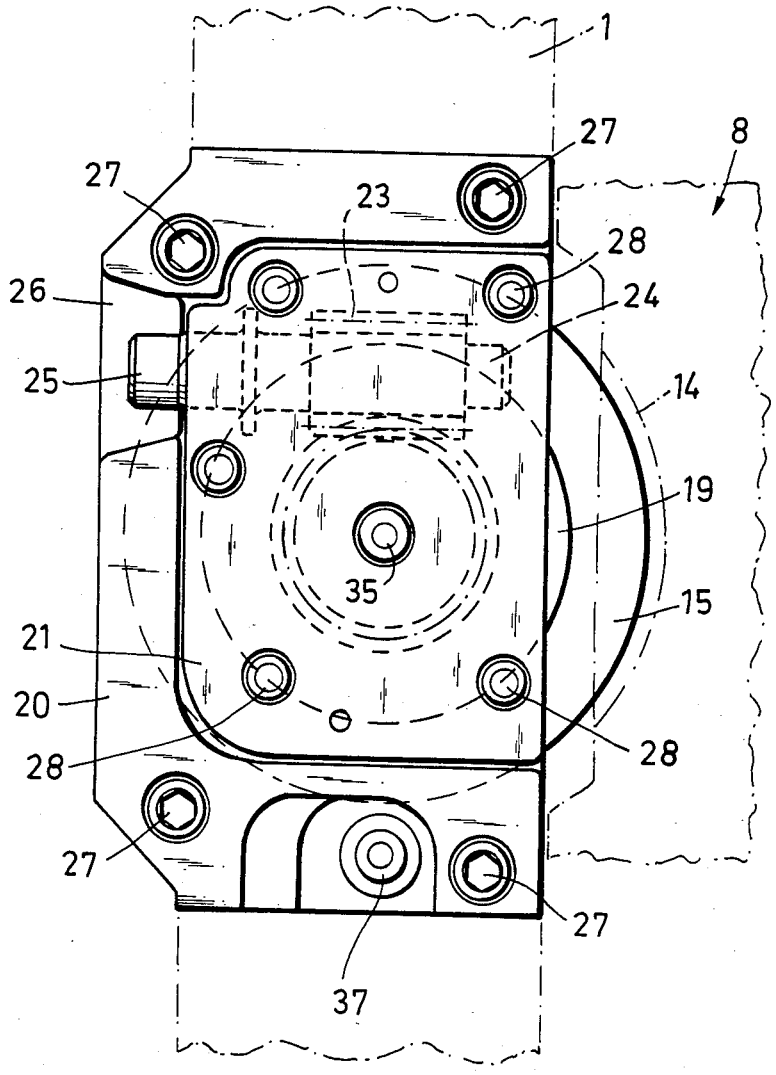

Referring to the drawings, the plough has a plough body 1 which is slidably guided on the workface side of a longwall conveyor 2. The plough is a sword plough, its body 1 being provided with a one-piece sword plate 3 which extends below the conveyor 2. Alternatively, the sword plate 3 could be made of multi-part construction. Cover plates 4 are bolted on to the goaf side of the conveyor 2, the cover plates forming a pair of vertically-spaced chain ducts 5 and 6 for an endless drive chain (not shown). In the known manner, the traction run of the drive chain is connected to guide blocks 7 associated with the sword plate 3. The guide blocks 7 move in the lower chain duct 6.

A carrier 8 is provided on the plough body 1 (or on a part built on to the plough body). The carrier 8 consists of a carrier plate 9, which is pivotally mounted, by means of a pivot pin 10, on a slide-like guide plate 11. The carrier plate 9 carries a set of roof cutters 13 at each end thereof. The guide plate 11 is vertically displaceable in a vertical, T-shaped guide 12 formed in the plough body 1. Thus, the carrier 8, together with the carrier plate 9 and the guide plate 11, is vertically displaceable relatively to the plough body 1. The pivot pin 10 is positioned adjacent to the lower end of the guide plate 11, and transversely of the workface. Thus, the carrier plate 9 can be pivoted in such manner that one set of roof cutters 13 is tilted into a working position for each direction of travel of the plough (the other set of roof cutters being pivoted away from the workface, that is to say into a rest position for each direction of plough travel). The set of cutters 13 in the working position is usually the leading set with respect to the direction of plough travel.

In order to set the level of the carrier 8, the guide plate 11 is provided with serrations 14 at its rear (goaf) side. The serrations 14 form a vertical toothed rack which meshes with a double-turn worm 15. The worm 15 is rotatably mounted in a worm chamber 16, which is formed by a recess in the plough body 1 (or in a part built on to the plough body, for example in intermediate block mounted on the plough body). The worm chamber 16 is open at that side presented to the carrier 8, so that the worm 15 can mesh with the serrations 14.

As shown best in FIG. 2, the worm 15 is connected to, and rotates with, a vertical worm shaft 18 by means of splines 17. The shaft 18 carries a worm wheel 19, which is disposed above the worm 15 in a gear chamber 22 formed by a housing plate 20 and a cover 21. The housing plate 20 and the cover 21 cooperate in defining the gear chamber 22 therebetween. The gear chamber 22 also contains a worm 23 which meshes with the worm wheel 19. The worm 23 is mounted on a shaft 24 which extends at right-angles to the worm shaft 18, that is to say horizontally. The shaft 24 constitutes the input shaft of a reduction gear. Its free end 25 is directed towards the goaf side, and is protected within a recess 26 formed in the housing plate 20.

The housing plate 20 is secured to the plough body 1 by means of screw-bolts 27, and the cover 21 is detachably secured within a recess in the housing plate by means of screw-bolts 28. The worm shaft 18 has, at its lower end, a journal 29, which is mounted in an opening 30 formed in the plough body 1 at the bottom of the worm chamber 16. The inner face of the cover 21 is provided with a centering and bearing stud 31, which engages in a cylindrical recess 32 formed at the other end of the worm shaft 18, that is to say in the worm wheel 19. Thus, the shaft 18 is rotatably mounted on the plough body 1 at one end, and on the cover 21 at the other end. When the cover 21 is detached, the shaft 18 and the worm wheel 19 can be inserted into, and withdrawn from, the gear chamber 22 from above. The connection between the worm 15 and the shaft 18, whereby they rotate in unison, enables the worm shaft 18 to be withdrawn easily from the worm 15, or to be introduced into it, from above.

The opposite faces of the worm 15 are provided with respective sealing rings 33 and 34 (see FIG. 2). The sealing ring 33 is in sealing contact with the bottom of the worm chamber 16, whereas the sealing ring 34 lies tightly against the lower face of the housing plate 20. In this way, the gear chamber 22, and the space within the chamber 16 that forms the rotary bearing 29, 31 for the worm shaft 18, are sealed off from the exterior to prevent the entry of dirt. The gear chamber 22, together with the bearing recess for the worm shaft 18, is filled with a lubricating oil. A screw is arranged at the centre of the cover 21, the screw 35 being effective to seal off the opening through which the lubricating oil is introduced. The screw 35 is provided with scale markings and so forms an oil gauge 36. At least one grease nipple 37, through which lubricating grease can be forced into the bearing chamber enclosed by the sealing rings 33 and 34, is provided in the housing plate 20.

As previously mentioned, the housing plate 20 and the cover 21 together form the gear chamber 22 which accommodates the worm wheel 19 and the worm 23. The plane of separation 38 between the housing plate 20 and the cover 21 coincides with the median plane of the worm 23 and of the worm wheel 19.

In order to adjust the level of the carrier 8, a hand lever (not shown) is fitted, from the goaf side, onto the free end 25 of the input shaft 24. Since the worm gear 19,23 has a reduction which is expediently of the order of 20:1, the adjustment of the level of the heavy carrier 8 can be carried out using a relatively low manual force. The worm gear 19,23 is distinguished by its simple and robust construction, by its small dimensions, and the ease with which it can be fitted and removed. Moreover, the use of the worm gear 19,23 results in a space-saving arrangement to the rear of the carrier 8.

We claim:

1. A plough for winning material from a mineral face, the plough having a plough body, a carrier for roof-level cutters, and means for adjusting the vertical position of the carrier with respect to the plough body, the adjustment means comprising a worm mounted in a worm chamber formed in the plough body and a toothed rack associated with the carrier, the worm chamber being open on that side which faces the toothed rack thereby to accommodate the worm meshing with the toothed rack and being closed from above by a housing plate detachably secured to the housing, the worm being fixed to a worm shaft which protrudes upwardly through said housing plate into a reduction gear chamber formed between said housing plate and a detachable cover, said worm shaft being drivable through reduction gearing connected to said worm shaft and arranged in said reduction gear chamber, said reduction gearing having an input shaft which extends substantially at right-angles to the axis of the worm shaft, the free end of the input shaft being directed towards the goaf side of the carrier.

2. A plough according to claim 1, wherein one end of the worm shaft is journalled in an aperture formed in the plough body, the other end of the worm shaft being journalled in said cover.

3. A plough according to claim 2, wherein the cover has a centering and bearing stud which engages in a recess formed in the end face of the worm shaft, thereby journalling the worm shaft on the cover.

4. A plough according to claim 2 wherein the worm has sealing rings which seal against the inner face of the housing plate and the base of the worm chamber defined by the plough body.

5. A plough according to claim 4, wherein the cover overlies the housing plate.

6. A plough according to claim 4, wherein the housing plate and the cover are positioned in a recess in the plough body, said recess defining the worm chamber.

7. A plough according to claim 4, wherein the reduction gearing comprises a second worm mounted on the input shaft, the second worm meshing with a worm wheel mounted on the worm shaft.

8. A plough according to claim 7, wherein the housing plate and the cover together form a gear chamber which houses the worm wheel and the second worm.

9. A plough according to claim 8, wherein the plane of separation between the housing plate and the cover coincides with the median plane of the second worm.

10. A plough according to claim 1, wherein the reduction gearing has a reduction ratio of 20:1.

* * * * *